US005564154A

United States Patent [19]

Cohn, III

[11] Patent Number: 5,564,154

[45] Date of Patent: Oct. 15, 1996

[54] BATHING MITT WITH SHAMPOO FACE SHIELD

[76] Inventor: Harold S. Cohn, III, 914 Point Peter Pl., St. Mary's, Ga. 31558

[21] Appl. No.: 429,932

[22] Filed: Apr. 27, 1995

[51] Int. Cl.[6] ..... A47K 7/02

[52] U.S. Cl. ..... 15/227; 2/160; 2/161.1; 2/161.6

[58] Field of Search ..... 15/227; 2/160, 2/161.1, 161.3, 161.6, 165; 401/7

[56] References Cited

U.S. PATENT DOCUMENTS

| | | | |
|---|---|---|---|
| 1,012,634 | 12/1911 | Guild | 15/227 |
| 1,193,529 | 8/1916 | Ellis | 15/227 |
| 1,565,005 | 12/1925 | Brashear | 441/57 |
| 1,669,010 | 5/1928 | Natho | 441/57 |
| 1,817,385 | 8/1931 | Marks | 15/227 |
| 2,726,410 | 12/1955 | Adamopoulos | 441/57 |
| 3,023,432 | 3/1962 | Loomis | 441/57 |
| 3,327,320 | 6/1967 | Forsyth | 15/227 |
| 3,938,207 | 2/1976 | Drescher | 441/57 |
| 4,058,863 | 11/1977 | Ferdico | 441/57 |
| 4,195,365 | 4/1980 | Eyman | 2/161.1 |
| 4,345,335 | 8/1982 | Shih-Li | 2/161.1 |
| 4,953,998 | 9/1990 | McCartherens | 15/227 |

FOREIGN PATENT DOCUMENTS

| | | | |
|---|---|---|---|
| 292339 | 6/1928 | United Kingdom | 15/227 |

*Primary Examiner*—David Scherbel
*Assistant Examiner*—Randall E. Chin
*Attorney, Agent, or Firm*—Thomas C. Saitta

[57] ABSTRACT

A combination bath mitt and shampoo shield for bathing infants and small children, comprising a cuff, a main body to receive the wearer's hand, one or more finger receptacles, a thumb receptacle, and a web member extending between the thumb receptacle and the finger receptacle adjacent the thumb receptacle, where the web member is liquid impermeable and is shaped to form a seal between itself and the forehead of the child when the thumb and forefinger of the wearer are spread to divert water from the child's face, and where some or all of the remaining components of the mitt are porous to receive water and soap lather to enable the mitt to be used as a lather applicator or scrubber.

13 Claims, 1 Drawing Sheet

FIG 2
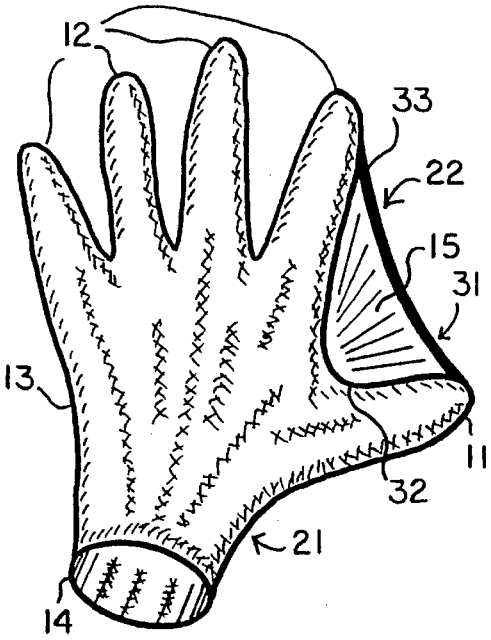
FIG 1
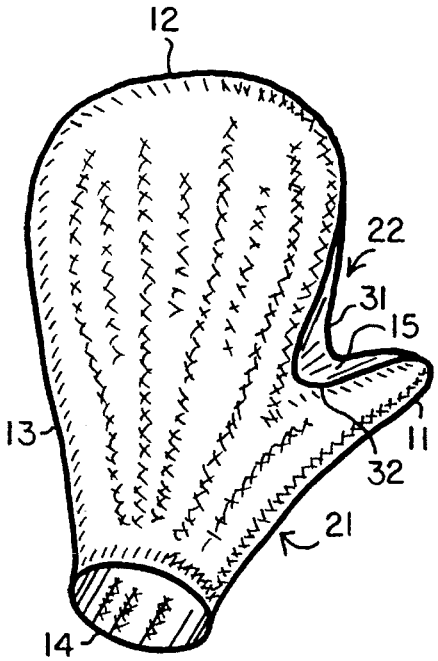
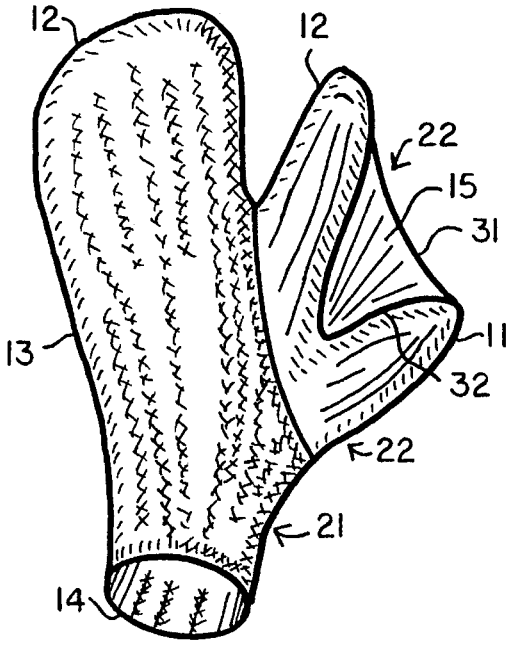
FIG 4
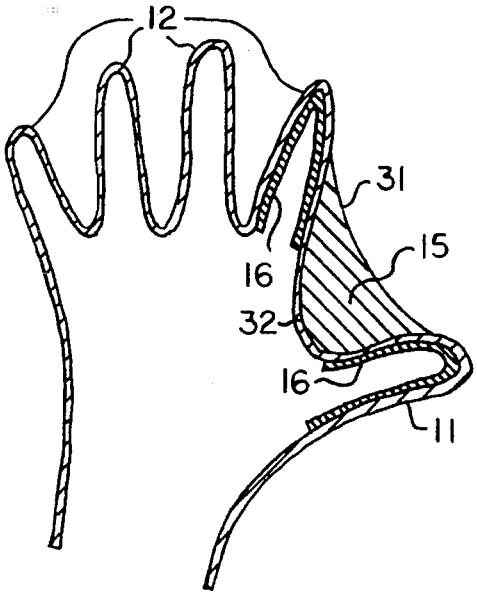
FIG 5
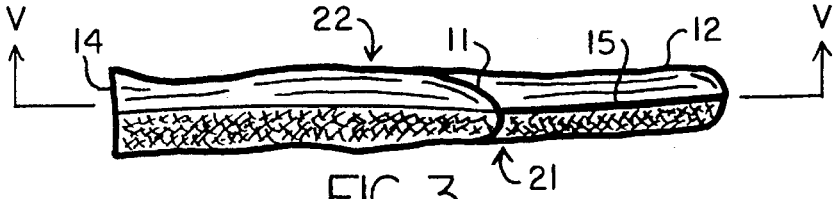
FIG 3

BATHING MITT WITH SHAMPOO FACE SHIELD

BACKGROUND OF THE INVENTION

This invention relates generally to hand coverings used in bathing to aid in the application of soap or lather to the body. More particularly, the invention relates to porous hand coverings such as mitts, both fingered and non-fingered, used in bathing infants or small children. Even more particularly, the invention is such a mitt which incorporates a non-absorbent, flexible web extending between the thumb and forefinger of the wearer, the web adapted to be positioned across the forehead of the infant to form a guard or shield to divert shampoo and water from the face of the child when the child's hair is being washed and rinsed.

It is common knowledge to anyone with children that infants and small children are almost universally against having their hair washed by the parent because the shampoo and water gets in their face and eyes. In the case of an infant, it is also necessary for the parent to hold the infant's head while rinsing, which increases the complexity involved in preventing shampoo and water from flowing down the infant's face. One known technique to divert rinse water from the child's face is for the parent to place the palm of the free hand against the child's forehead to form a dam which diverts the water to either side of the head, while simultaneously tilting back the child's head so that most of the water flows to the rear. While somewhat effective, this is obviously not a good solution to the problems outlined above.

Shampoo masks or visors are known, an example of which is shown in U.S. Pat. No. 1,923,340 to Steckler, but these offer a less than optimal solution to the problem, as the child must first be convinced to wear the mask or visor, and the mask or visor must be attached to the head of the child in some manner such as an elastic string, which impedes and interferes with the hair which is to be washed. Proper fit of the mask or visor with small infants is also difficult to attain.

It is a purpose of this invention to provide a hand covering device which easily forms a seal against the forehead of the child to divert shampoo and rinse water from the child's face and eyes, while simultaneously enabling the parent to maintain a safe and secure grasp of the child's head to restrict unwanted movement and, in the case of an infant, to keep the head above water. It is a further purpose to provide such a device which combines a water impermeable shampoo shield web extending between the thumb and forefinger with a porous mesh, foam or cloth hand covering, thereby allowing the device to double as both a shampoo shield and a bathing mitt for direct application of soap lather to other parts of the child. It is a further object to provide such a device which can have any number of finger sheaths, whereby the device can be constructed either as a mitten with a single receptacle for the four fingers besides the thumb, a true glove with individual receptacles for each finger, or a mitt with any number of receptacles in between to accommodate different finger groupings.

SUMMARY OF THE INVENTION

The invention is a hand covering or mitt for bathing infants and young children which comprises in general a cuff portion to allow insertion of the wearer's hand into the interior of the mitt, a main body portion for enveloping the hand of the wearer, a thumb receptacle to receive the thumb of the wearer, one or more finger receptacles to receive individual or plural groupings of the wearer's fingers, and a web member extending between the thumb receptacle and the finger receptacle adjacent the thumb receptacle, i.e., the receptacle containing the forefinger of the wearer. The web member is preferably flexible, elastic, liquid impermeable and non-absorbent, and may be constructed of a rubber, latex or similar type material. The web member preferably has a free edge generally concave in shape and is continuously attached to the finger receptacle, main body and thumb receptacle whereby water cannot pass between the web member and the other components of the mitt. The web member is adapted to conform to the general shape of a child 's forehead when the forefinger and thumb of the wearer are stretched apart, so that positioning the web member against the child's forehead creates a shield or dam which prevents water from flowing down the face of the child. The main body, finger receptacles and thumb receptacle are preferably constructed at least partially of a porous mesh, foam, cloth or absorbent material which allows for the absorption or passage of water and soap into the mitt, such that the mitt can be used as a soap lather applicator and scrubber as well as a shampoo shield. The thumb receptacle and finger receptacle may contain structural members to reinforce the material comprising those components and prevent stretching or excess movement of the components relative to the hand or fingers when the mitt is in use.

BRIEF DESCRIPTION OF THE DRAWINGS

FIG. 1 is a view of the invention in the preferred embodiment with no individual finger receptacles except for the thumb receptacle.

FIG. 2 is a view of the invention in an alternative embodiment where each finger is retained in a separate finger receptacle.

FIG. 3 is a side view of the invention in an alternative embodiment where the palm side of the mitt is made of a mesh, cloth, foam or absorbent material and the backhand side of the mitt is made of a water impermeable material.

FIG. 4 is a view of another alternative embodiment of the invention illustrating a different finger grouping and the construction of the forefinger receptacle and thumb receptacle from a water impermeable material.

FIG. 5 is a cross-sectional view taken along line V—V of FIG. 3, showing the addition of structural reinforcing members into the thumb receptacle and the forefinger receptacle.

DETAILED DESCRIPTION OF THE INVENTION

With reference now to the drawings, the invention will be described with regard to the preferred embodiment and best mode. The term mitt is herein used to describe a hand covering with one thumb receptacle and any number of finger receptacles from one (commonly referred to as a mitten) to four (commonly referred to as a glove). In general, the invention is a hand covering mitt adapted for bathing infants and young children comprising in general a cuff portion 14 to allow insertion of the wearer's hand into the interior of the mitt, a main body portion 13 which envelopes the wearer's palm and backhand, a thumb receptacle 11 for receiving the wearer's thumb, one or more finger receptacles 12 for receiving the wearer's fingers either individually or in various groupings, and a web member 15 extending between the thumb receptacle 11 and finger receptacle 12 adjacent the thumb receptacle 11. As seen in the preferred embodiment of FIG. 1, the mitt comprises one finger receptacle 12, while alternative embodiments are illustrated in FIG. 2, where the mitt has four finger receptacles, and in FIG. 4, where an embodiment with two finger receptacles 12, one containing the forefinger and the other containing the remaining three fingers, is shown. It is also contemplated that the mitt could also be constructed with two finger receptacles 12 grouped either as (i) forefinger/middle finger and ring finger/little finger or as (ii) forefinger/middle finger/ring finger and little finger. Likewise, the mitt could be constructed with three finger receptacles 12 grouped either as (i) forefinger/middle finger, ring finger and little finger, (ii) forefinger, middle finger/ring finger, little finger, or (iii) forefinger, middle finger, ring finger/little finger. The embodiment of FIG. 1 with one finger receptacle 12 is preferred for maximizing the efficiency of the mitt in applying lather and scrubbing, since a larger continuous surface is presented, while the embodiment shown in FIG. 2 with four finger receptacles 12 provides the greatest control and dexterity. The various two and three finger receptacle 12 embodiments offer compromise configurations between these two extremes.

The web member 15 extends from thumb receptacle 11 and finger receptacle 12 adjacent the thumb receptacle, such that free edge 31 extends across the gap between the two. Free edge 31 may terminate at any point from the tip to near the base of thumb receptacle 11 and finger receptacle 12, so long as the final structure provides sufficient length to free edge 31 to fully and continuously contact the child's forehead when in use as a shampoo shield. The free edge 31 is preferably concave or arcuate in configuration. The attached edge 32 of web member 15 is continuously connected to the thumb receptacle 11, finger receptacle 12, and the segment of the main body portion 13 at the base of the thumb receptacle 11 and finger receptacle 12 by any suitable methods or mechanisms, such as heat welding, adhesives, stitching or the like, such that there are no openings or apertures between the web member 15 and the thumb receptacle 11, main body 13 and finger receptacle 12. Web member 15 is composed of a water impermeable material 22 and is preferably flexible and elastic. Suitable materials for construction of web member 15 are latex, rubber or the like. It is preferred that the material 22 be flexible and elastic so that the free edge 31 of web member 15 can comfortably conform to the shape and size of the child's forehead when in use as a shampoo shield, and so that the mitt can be used with children of various sizes. The use of an elastic material allows the wearer to expand the gap between the forefinger and thumb to the optimum distance to best seal the junction between the web member 15 and the child's forehead, preferably enabling the wearer to expand the gap to the maximum separation distance of the wearer's fingers if desired. Free edge 31 can have an increased thickness relative to the remainder of web member 15 to create a thickened band or bead 33, as shown in FIG. 2, for better sealing efficiency. Free edge 31 is preferably concave or arcuate, again to better conform to the child's forehead. Web member 15 can be relatively extensive, with free edge 31 occupying a position generally adjacent to the imaginary line connecting the tip of the thumb receptacle 11 to the tip of the finger receptacle 12, such that web member 15 has a generally large surface area, as shown in FIG. 2. Alternatively, the free edge of web member 15 may occupy a position more adjacent and complementary to the attached edge 32, as shown in FIG. 1, such that the surface area of web member 15 is generally small. Provision of the extensive web member 15 allows the web member 15 to also be used as a water scoop for rinsing soap lather off other body areas. Provision of the limited web member 15 allows the wearer to extend the forefinger and thumb farther around the child's head for a more secure grip.

In order for the mitt to function as a soap lather applicator or scrubber, a portion of the mitt must be constructed of a porous material 21 which is receptive to water and soap lather. The material 21 can be of any commonly known foam, woven, mesh, cloth, napped or absorbent material which is flexible and preferably relatively soft to the touch. While some elasticity is preferred for comfort and ease of putting on the mitt, the material 21 should be relatively limited in this characteristic so that the mitt will not be excessively distorted or pulled off the wearer's hand when used to apply lather or to scrub. It is preferred that the cuff 14, main body 13, finger receptacles 12 and thumb receptacle 11 all be constructed of the porous material 21, as shown in FIGS. 1 and 2, as this maximizes the efficiency of the mitt as a lather applicator or scrubber. It is possible however, to construct the mitt with any combination of components composed of either the porous material 21 or the impermeable material 22, or even with an individual component having one portion constructed of porous material 21 and the remaining portion constructed of impermeable material 22. For example, FIG. 3 illustrates an embodiment where the entire palm side of the mitt is composed of the porous material 21 and the entire backhand side is composed of the impermeable material 22. Alternatively, FIG. 4 shows an embodiment where the thumb receptacle 11 and adjacent finger receptacle 12 are composed of the water impermeable material 22, while the remaining finger receptacle 12, the main body 13 and the cuff 14 are composed of the porous material 21. In this embodiment, the structural integrity of thumb receptacle 11 and adjacent finger receptacle 12 are improved, the gripping ability of the thumb receptacle 11 and finger receptacle 12 are improved, and the combination of impermeable thumb receptacle 11 and finger receptacle 12 with the web member 15 creates an expanded shampoo shield to better channel water away from the child's face. As an alternative means for increasing the structural integrity of the thumb receptacle 11 and finger receptacle 12 and reducing the likelihood that the mitt will be excessively distorted during use, one or more reinforcing members 16 may be added to the interior or exterior of these components, as shown in FIG. 5. These reinforcing members 16 may comprise any suitable mechanism for adding structure to the component, such as a thickened wall in the thumb receptacle 11 or finger receptacle 12 or separate tubular or finger-shaped inserts adapted to be incorporated therein, either affixed or removable.

To use the mitt as a bathing mitt, the wearer simply submerges the mitt into water to absorb some liquid and rubs soap into the wet mitt to produce lather. The lather can be rinsed out after application and scrubbing by repeated dipping of the mitt into the water. To use the mitt as a shampoo shield, all lather is rinsed from the mitt, the wearer expands the thumb receptacle 11 and finger receptacle 12 and positions the free edge 31 of the web member generally horizontally across and against the child's forehead below the hairline and above the eyes, with ends of the thumb receptacle 11 and finger receptacle 12 gripping either side of the child's head toward the temple area. Proper pressure against the child's skin coupled with the correct expansion creates a water-tight seal between the free edge 31 of web member 15 and the child's forehead, such that any water or shampoo which flows to the front will be blocked and diverted by the impermeable web member 15 to the sides of the child's face or down onto the backhand of the mitt itself.

It is understood that equivalents and substitutions may be obvious to those skilled in the art, so the true scope and definition of the invention is to be as set forth in the following claims.

I claim:

1. A combination bathing mitt and shampoo shield device worn on a person's hand to prevent shampoo and water from flowing into the face of a child or infant, comprising a main body portion adapted to receive the person's hand, a cuff portion connected to said main body portion to allow insertion of the person's hand into said main body portion, a thumb receptacle connected to said main body portion, a finger receptacle connected to said main body portion adjacent said thumb receptacle and adapted to receive either individual or groups of fingers, said device having only a single web member, said web member extending between said thumb receptacle and said adjacent finger receptacle, said web member having a free edge and a connected edge, said connected edge being continuously connected to said thumb receptacle, said adjacent finger receptacle and a part of said main body portion, said web member being composed of a water impermeable, elastic material whereby said thumb receptacle and said adjacent finger receptacle can be separated the maximum finger and thumb separation distance, and said main body portion, said thumb receptacle and said adjacent finger receptacle being composed solely of a porous material capable of absorbing water and soap later, where said free edge of said web member further comprises a thickened bead member.

2. The device of claim 1, wherein said free edge of said web member is concave.

3. The device of claim 1, wherein said free edge of said web member is arcuate.

4. The device of claim 1, wherein each of said thumb receptacle and said adjacent finger receptacle has an end and said free edge of said web member is connected adjacent said end of said thumb receptacle and said adjacent finger receptacle.

5. The device of claim 1, wherein said thumb receptacle and said adjacent finger receptacle further comprise reinforcing members.

6. The device of claim 5, wherein said reinforcing members comprise thickened walls.

7. The device of claim 5 wherein said reinforcing members comprise tubular inserts positioned internally within said thumb receptacle and said adjacent finger receptacle.

8. A combination bathing mitt and shampoo shield device worn on a person's hand to prevent shampoo and water from flowing into the face of a child or infant, comprising a main body portion adapted to receive the person's hand, a cuff portion connected to said main body portion to allow insertion of the person's hand into said main body portion a thumb receptacle connected to said main body portion, and at least two finger receptacles connected to said main body portion, one of said at least two finger receptacles being adjacent said thumb receptacle remaining of said at least two finger receptacles being non-webbed, said at least two finger receptacles being adapted to receive either individual or groups of fingers, said device having only a single web member said web member extending between said thumb receptacle and said adjacent finger receptacle, said web member having a free edge and a connected edge, said connected edge being continuously connected to said thumb receptacle, said adjacent finger receptacle and a part of said main body portion, said web member being composed of a water impermeable elastic material whereby said thumb receptacle and said adjacent finger receptacle can be separated the maximum finger and thumb separation distance, said thumb receptacle and said adjacent finger receptacle being composed solely of a water impermeable material, and said main body portion and the remaining of said at least two non-webbed finger receptacles being composed of a porous material capable of absorbing water and soap lather, wherein said free edge of said web member further comprises a thickened bead member.

9. The device of claim 8, wherein said free edge of said web member is concave.

10. The device of claim 8, wherein said free edge of said web member is arcuate.

11. A combination bathing mitt and shampoo shield device worn on a person's hand to prevent shampoo and water from flowing into the face of a child or infant, comprising a main body portion adapted to receive the person's hand, a cuff portion connected to said main body portion to allow insertion of the person's hand into said main body portion, a thumb receptacle connected to said main body portion, and a finger receptacle connected to said main body portion adjacent said thumb receptacle, said adjacent finger receptacle being adapted to receive either individual or groups of fingers, said device having only a single web member, said web member extending between said thumb receptacle and said adjacent finger receptacle, said web member having a free edge and a connected edge, said connected edge being continuously connected to said thumb receptacle, said adjacent finger receptacle and a part of said main body portion, said device having a palm side and a backhand side, said palm side of said main body portion and said palm side of said adjacent finger receptacle being composed of a porous material capable of absorbing water and soap lather, said backhand side of said main body portion and said backhand side of said adjacent finger receptacle being composed of a water impermeable material, and said web member being composed of a water impermeable elastic material whereby said thumb receptacle and said adjacent finger receptacle can be separated the maximum finger and thumb separation distance, wherein said free edge of said web member further comprises a thickened bead member.

12. The device of claim 11, wherein said free edge of said web member is concave.

13. The device of claim 11, wherein said free edge of said web member is arcuate.

* * * * *